United States Patent [19]

Bond

[11] Patent Number: 4,744,117

[45] Date of Patent: May 17, 1988

[54] PROP-LIKE POSITIONING DEVICE FOR HEMISIDE RECLINING PERSONS

[76] Inventor: Helen Inez Bond, Rural Route #1, Fremont, Dodge County, Nebr. 68025

[21] Appl. No.: 924,363

[22] Filed: Oct. 29, 1986

Related U.S. Application Data

[63] Continuation-in-part of Ser. No. 651,346, Sep. 17, 1984, abandoned, which is a continuation-in-part of Ser. No. 422,824, Sep. 24, 1982, abandoned.

[51] Int. Cl.[4] ..... A47C 20/00; A47C 20/02

[52] U.S. Cl. ..... 5/431; 5/436; 5/437; 5/446

[58] Field of Search ..... 5/431, 434, 436, 437, 5/442, 446, 447, 462, 465, 485, 490, 496, 498

[56] References Cited

U.S. PATENT DOCUMENTS

| | | | |
|---|---|---|---|
| 200,504 | 2/1878 | Buell | 5/440 X |
| 1,343,881 | 6/1920 | Christensen | 5/485 |
| 1,974,723 | 9/1934 | Richig | 5/434 X |
| 2,217,819 | 10/1940 | Rook et al. | 5/485 |
| 2,724,133 | 11/1955 | Sorrell | 5/446 X |
| 3,512,189 | 5/1970 | Swanson | 5/431 |
| 3,578,383 | 5/1971 | Earl | 5/434 X |
| 3,924,282 | 12/1975 | Bond | 5/431 |
| 4,197,603 | 4/1980 | Greenhawk, Sr. | 5/431 |
| 4,317,245 | 3/1982 | El-Amin | 5/497 |
| 4,574,412 | 3/1986 | Smith | 5/436 |

*Primary Examiner*—Michael F. Trettel
*Attorney, Agent, or Firm*—George R. Nimmer

[57] ABSTRACT

Prop-like positioning devices for hemiside reclining persons and including: a bolster or other lofty pillowy structure extending along a longitudinal-axis and being in longitudinally extending attached relationship to a flexible apron member extending lengthwise along a lateral-axis. The apron member is superimposable upon a bed-like reclining surface directly beneath a longitudinally extending body torso. Plural pockets exist on both lateral sides of the pillowy structure and for receiving selectable therapeutic devices for the reclining person, and preferably a pair of vertically open pockets on both lateral sides. Other permissible optional features render the positioning device usable by reclining persons not having constant nursing or attendant care.

19 Claims, 5 Drawing Sheets

FIG. 1
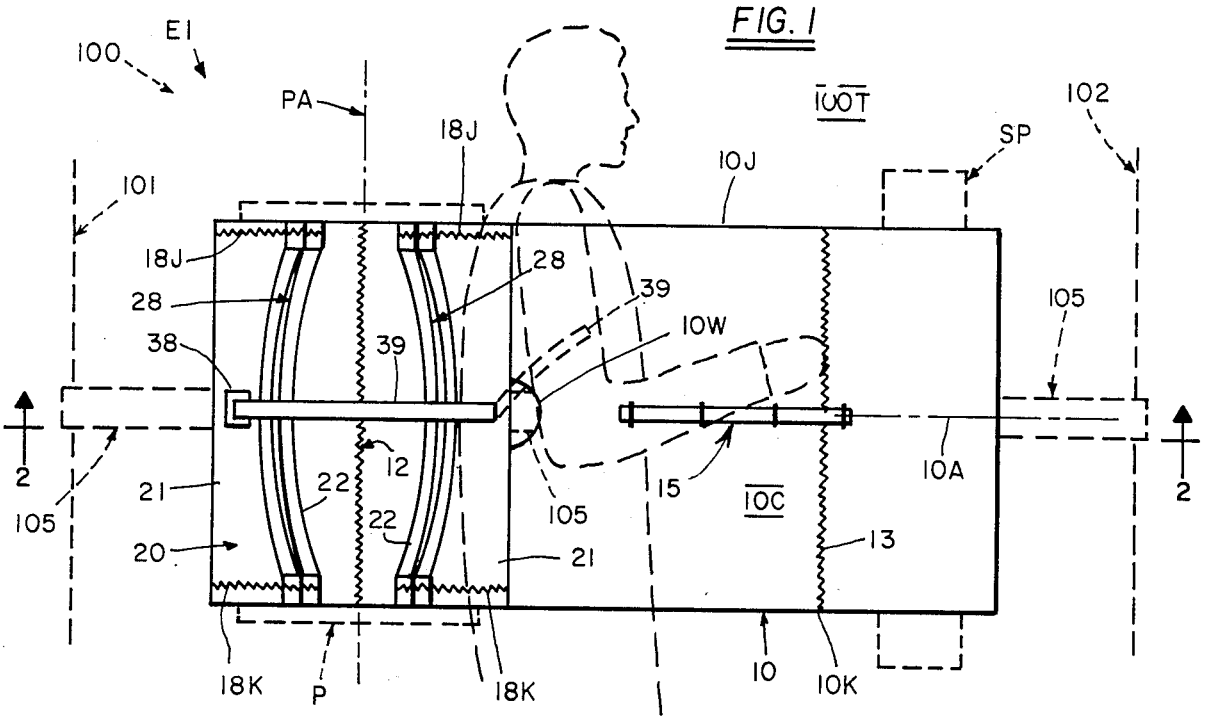
FIG. 9
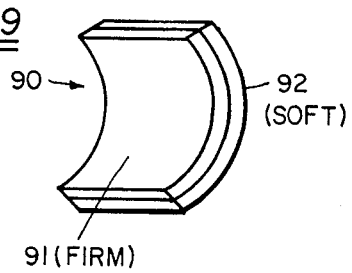
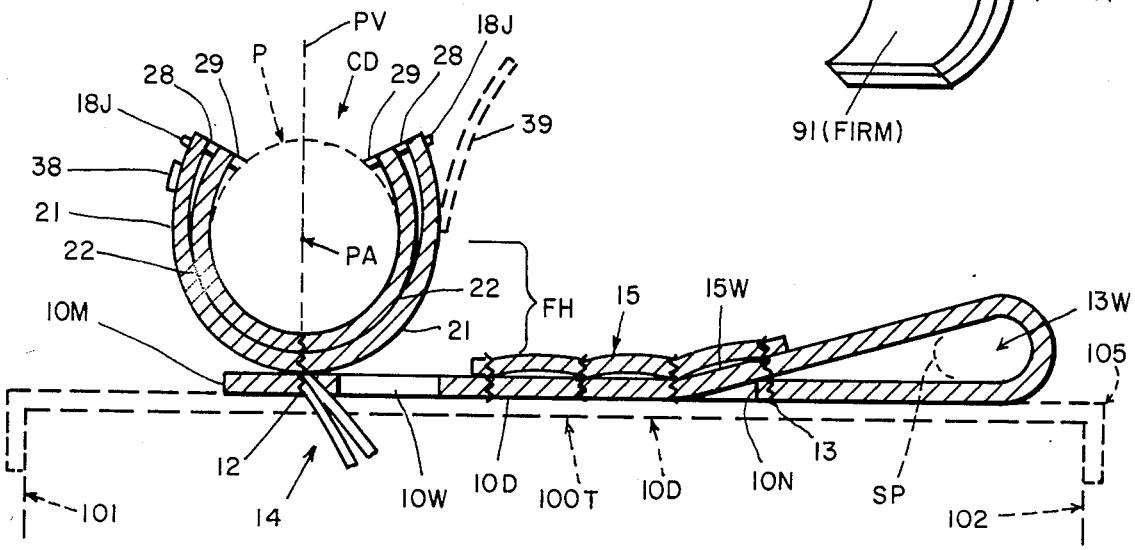
FIG. 2

FIG. 3
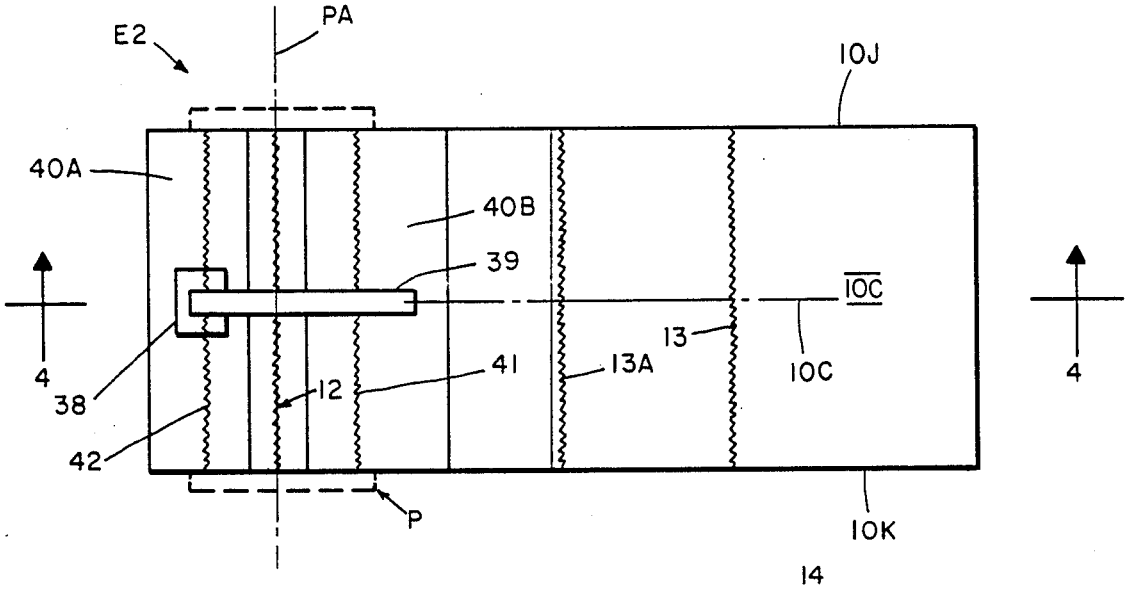
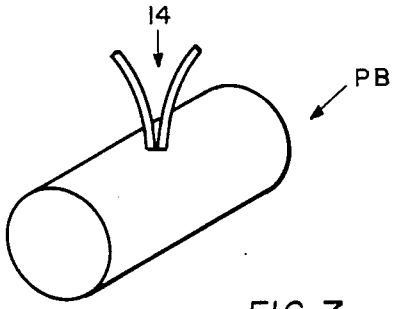
FIG. 7
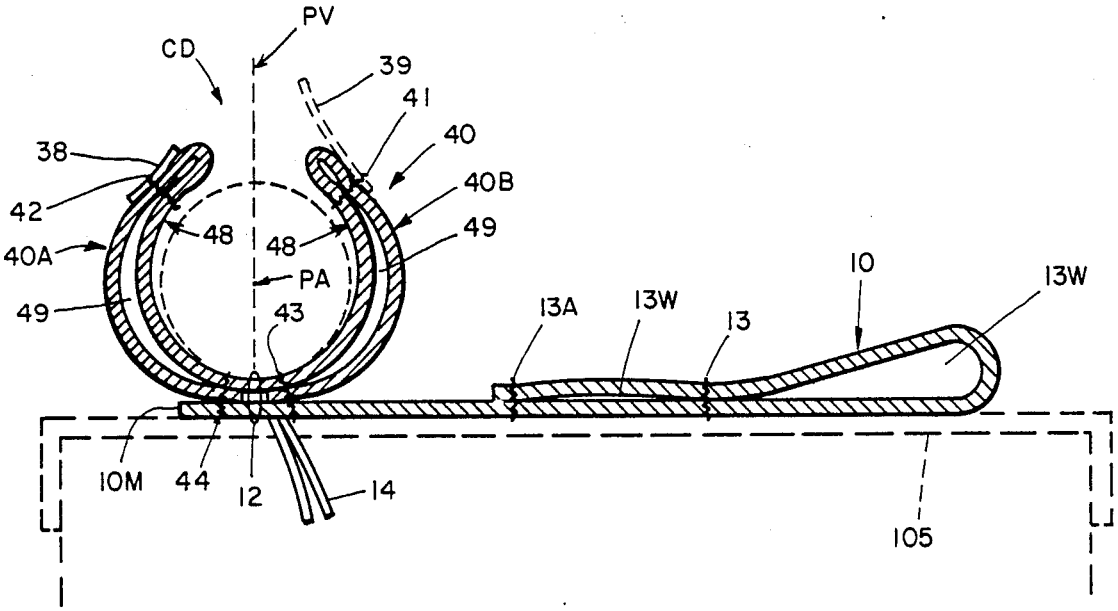
FIG. 4

PROP-LIKE POSITIONING DEVICE FOR HEMISIDE RECLINING PERSONS

RELATED APPLICATIONS

This application is a continuation-in-part of pending application Ser. No. 06/651,346 (filed Sept. 17, 1984), now abandoned, and which in turn was a continuation-in-part of application Ser. No. 06/422,824 (filed Sept. 24, 1982) now abandoned.

BACKGROUND OF THE INVENTION

As typified by U.S. Pat. Nos. 2,782,427, 3,938,205, 4,074,376, prop-like positioning devices are adapted to help sleeping or other reclining persons in a hemiside position. However, prior art devices are deficient in that they do not provide selectable ancillary therapeutic treatments, nor are they usable by muscularly debilitated persons not having constant attendant or nursing care. For example, the prior art devices are not adapted to provide ancillary selectable therapy such as heat, contour modification, etc., nor are they adaptable for self-help modes by muscularly debilitated persons.

GENERAL OBJECT OF THE INVENTION

With the above general objective in view, and together with specific and ancillary objectives which will become more apparent as this description proceeds, the prop-like positioning device concept of the present invention generally comprises: a flexible apron member extending lengthwise along a lateral-axis and superimposable upon a bed-like reclining surface directly beneath the user's longitudinally extending torso; a longitudinally extending bolster or other pillowy means that is longitudinally attachable in overlying relationship to the apron member; pockets-forming sheeting means intervening between the pillow means and the apron member and providing pockets laterally separated by the pillow means, the respective pockets being adapted to removably receive sequential therapeutic devices; and together with related optional features such as frontal-support means, bedstrap anchoring means, specially arrayed pockets, novel bolster type pillow means, etc.

BRIEF DESCRIPTION OF THE DRAWING

In the drawing, wherein like characters refer to like parts in the several views, and in which:

FIG. 1 is a top plan view of a representative embodiment "E1" of the prop-like positioning device of the present invention, phantom lines indicating the environment of a reclining body torso, frontal-support means, and a bedstrap;

FIG. 2 is a sectional elevational view taken along line 2—2 of FIG. 1;

FIG. 3 is a top plan view of a second embodiment "E2" of the prop-like supporting device;

FIG. 4 is a sectional elevational view taken along line 4—4 of FIG. 3;

FIG. 7 is a perspective view of a novel bolster-like pillow means having bedstrap anchoring capability;

FIG. 9 is a perspective view of a novel resiliently layered therapeutic device for pocketable usage in the prop-like positioning devices;

DETAILED DESCRIPTION OF THE DRAWING

Figure 6:
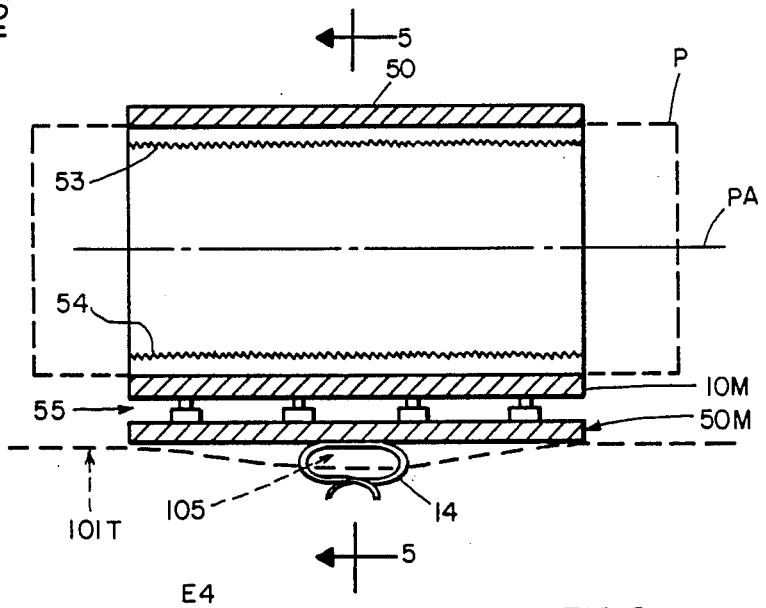
FIG. 6 is a sectional elevational view taken along line 6—6 of FIG. 5.

In a general sense, the prop-like positioning device of the present invention comprises: a flexible apron member (10) extending lengthwise along a lateral-axis 10A and adapted to be superimposed upon a bed-like reclining surface 100T immediately below a longitudinally extending hemiside reclining torso; and a longitudinally extending uprightable flexible casing member (20, 40, 50, PC, etc.) adapted to substantially surround longitudinal-axis "PA" of a lofty pillow means ("P", "PB", "P5", "PF", etc.) and having a plurality of longitudinally extending stations including an apron-connector station (e.g. 12, 55), at least one vertically openable plural-pockets station (e.g. 28–29, 28A–29, 48–49, 58–59) adapted to removably receive selectable therapeutic devices for the hemiside reclining person, and an optional casing-discontinuity station ("CD") permitting insertion and removal of certain pillow means and together with temporary fastening means therefor (e.g. 38–39, 55).

Turning initially to FIGS. 1 and 2 which depict embodiment "E1" and comprising as the apron member 10 a rectangular flexible fabric sheet extending lengthwise along lateral-axis 10A. Rectangular apron sheet 10 has an upper-surface 10C, lower-surface 10D, and four edges including lengthwise edges 10J and 10K and shorter edges 10M and 10N. Apron lower-surface 10D is superimposable upon the bed-like a reclining surface 100T whereby lateral-axis 10A is normal to bed longitudinal sides 101 and 102. Oftentimes for patient care, a bed (100) might be provided with a laterally crosswise bedstrap 105 located directly beneath apron 10. Shown in phantom line is the longitudinally extending upper torso of a hemiside reclining person (i.e. lying generally parallel to bed sides 101, 102, and to axis "PA"). Moreover, the torso transversely intersects apron 10 and with the spinalside restable against uprightable casing member 20.

For embodiment "E1", flexible casing member 20 comprises a pair of flexible fabric pockets-forming sheeting means including a primary-sheet 21 and a secondary-sheet 22 thereabove. Longitudinally extending central portions of sheets 21 and 22 are stitched (at 12) to apron sheet 10 near its terminus 10M. Thus, longitudinally extending sewing line 12 provides a longitudinally extending apron-connector station for casing 20 and divides sheets 21 and 22 into a pair of flexible wings located on both lateral sides of said station 12. The longitudinally extending free-edges of said flexible wings are adapted to provide a longitudinally extending casing-discontinuity station "CD" permitting insertion and removal of longitudinal ("PA") pillow means ("P", "PB", etc.). There are temporarily secureable fastener means carried adjacent to and for temporarily closing casing-discontinuity station "CD". Such fastener means might take a variety of forms e.g. as the combination of hooks-and-eyes "Velcro" parts 38 of forms e.g. a "VELCRO" type fastener including fabric hooks and eyes (38, 39) carried by the wings of secondary-sheet 22. When the pillow means is inserted and temporarily secured at station "CD", its longitudinally extending axis "PA" is located a finite-height "FH" above apron 10 whereby a vertical plane "PV" might pass through axis "PA" and longitudinal attachment station 12. Moreover, the casing member carries at least one longitudinally extending plural-pockets station whereby at least two laterally sequentially spaced pockets (e.g. 28–29) preferably intervene between the reclining person's spinalside and the pillow means. Therapeutic devices such as heating pads, posture boards (90), etc., might be received singly or in tandem within such casing pockets. The respective casing wings are peripherally stitched at 18J and at 18K to close the two longitudinally separated upright ends of the four upwardly vertically open pockets depicted.

Preferably, the positioning device includes bedstrap anchoring means extending below the apron member lower-surface 10D. In the embodiments "E1", "E2", "E3", and "E5", the bedstrap anchoring means takes the form of string-like ties 14 attached to apron member 10 adjacent the apron-connector station (12), and for tying around a bedstrap 105. In embodiments "E1", "E5", and "E6", apron member 10 is aperturable at 10W to provide access to the anchoring means (e.g. 14) by the unattended reclining person.

In addition to having their spinalside supported by the uprightable casing member, certain hemiside reclining persons require frontal-support means for their anteriorside. In embodiments "E1", "E5", and "E6", such frontal-support means is provideable by doubling-back and securing a portion of apron 10 with stitching 13 whereby auxiliary-pillowmeans (e.g. "SP") might be inserted therewithin. A ribbon-like member 15 might also be attached as upstanding loops to apron member 10 whereby the frontal-support means might also include, for the auxiliary-pillow means, smaller bolsters or the like attached to loops 15W.

Embodiment "E2" of FIG. 3 and FIG. 4 differs from embodiment "E1" mainly at the casing member and at the frontal-support means. Casing member 40 comprises a single flexible pockets-forming sheet having its longitudinally extending medial portion stitched (at 12) to provide the apron-connector station and to delineate comparatively lengthy wings 40A and 40B. Each wing has a longitudinally extending and stitchably secured (41, 42) medial-fold which together define casing-discontinuity station "CD". And both layers of at least one wing are stitchably secured (e.g. 43, 44) to apron member 10 to provide longitudinally extending plural-pockets (48, 49). The frontal-support means depicted is provided by a doubling-back of apron 10 and secured with stitching lines 13 and 13A resulting in apron-channels 13W which might be similarly provided with auxiliary-pillow-means e.g. "SP".

Figure 5:
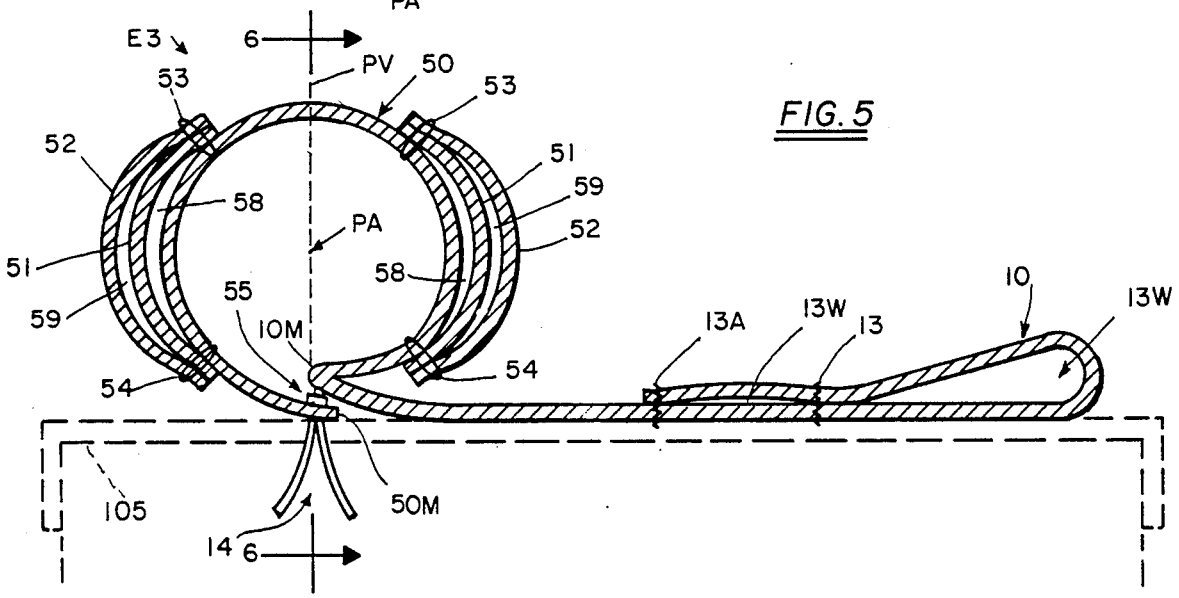
FIG. 5 is a sectional elevational view, akin to FIGS. 2 and 4, of a third embodiment "E3" and taken along line 5—5 of FIG. 6.

Embodiment "E3" of FIGS. 5 and 6 differs from embodiment "E2" mainly at its casing member (50) which comprises an extension of the flexible sheet material forming apron 10 and eventually terminating at edge 50M. A longitudinally extending line of snaps-type mechanical fasteners 55 along sheet locations 10M and 50M provides both the apron-connector station and the casing-discontinuity station. Flexible pockets-forming sheets (e.g. 51, 52) that are stitched (53, 54) to the casing member provide longitudinally open plural-pockets (58, 59) disposed on both lateral sides of vertical plane "PV".

Figure 8:
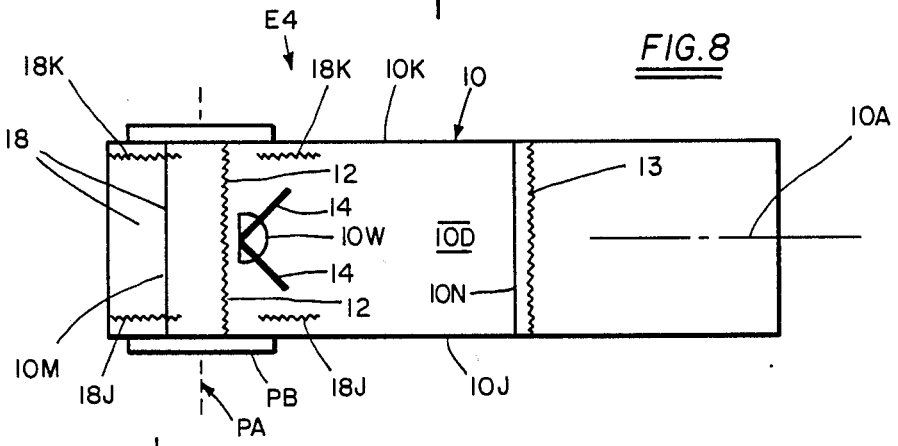
FIG. 8 is a bottom plan view of a fourth embodiment "E4", akin to embodiment "E1" and utilizing the structure of FIG. 7.

FIG. 7 is a perspective view of a cylindrical bolster type pillowy means "PB" that is itself provided with bedstrap anchoring means (14). Thus, as indicated in FIG. 8 embodiment "E4", when the pillow means "PB" is surrounded by the casing member, the bedstrap anchoring means of bolster style "PB" might protrude downwardly as 14 through apron aperture 10W.

FIG. 9 refers to a resiliently-layered structure 90 comprising a firm board layer 91 having attached thereto a layer (92) of lambswool or other relatively soft material. Novel structure 90 can function as a posture type therapeutic device to be removably received into a pocket of the prop-like positioning devices.

Figure 10:
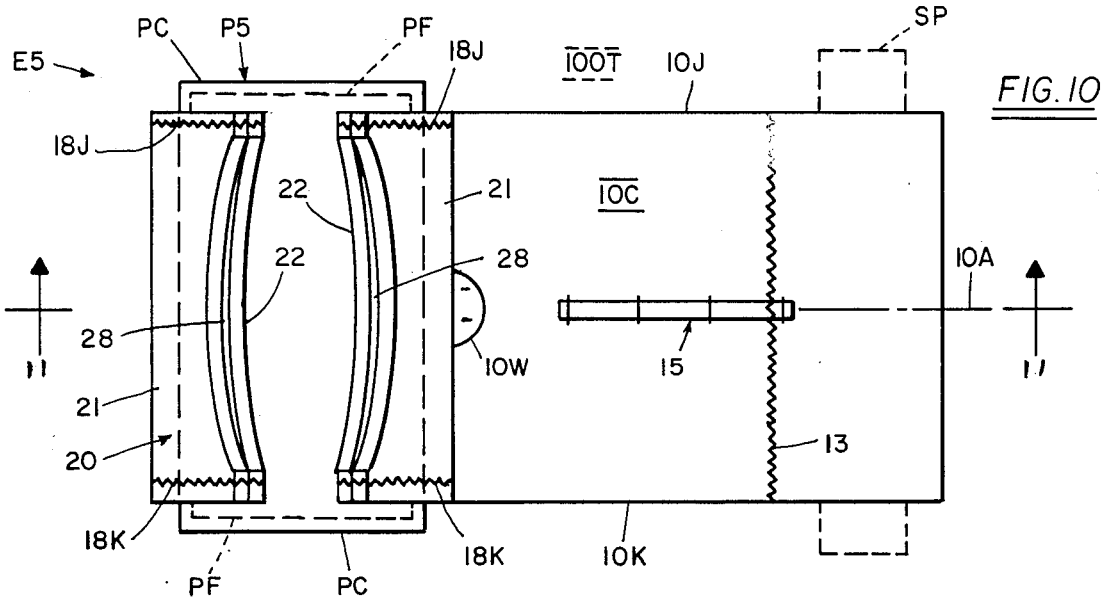
FIG. 10 is a top plan view of a fifth embodiment "E5"
Figure 11:
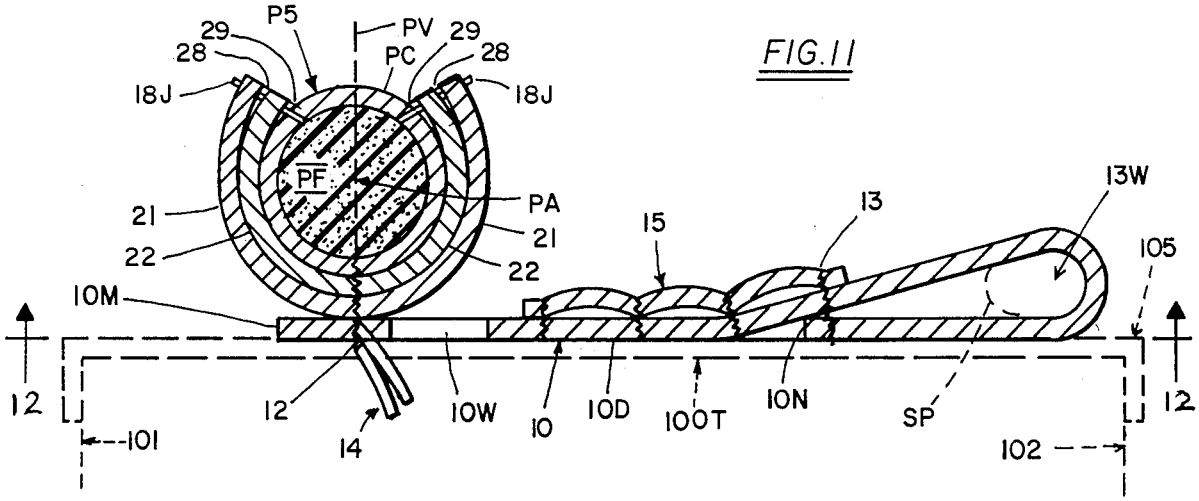
FIG. 11 is a sectional elevational view of embodiment "E5" and taken along line 11—11 of FIG. 10.
Figure 12:
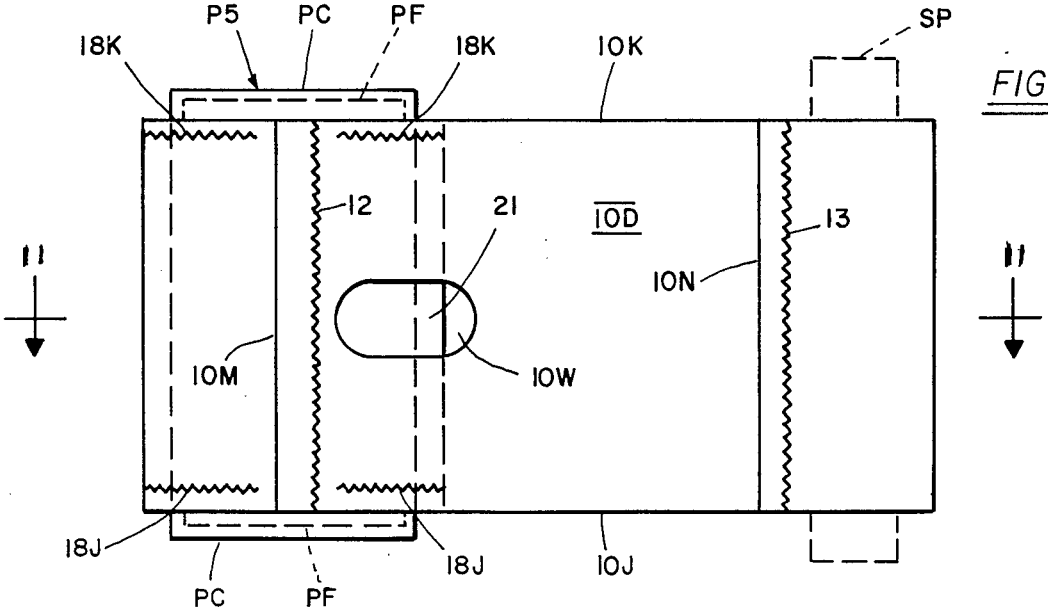
FIG. 12 is a bottom plan view of embodiment "E5"

Though generally similar to embodiment "E1" of FIGS. 1 and 2, embodiment "E5" of FIGS. 10–12 is specifically directed to a pillow means style "P5" comprising a fabric casing "PC" that fully surrounds a resiliently compressible filling "PF" which is preferably of launderable material. Whereas in embodiment "E1" the longitudinal sewing line 12 attaches primary-sheet 21 and secondary-sheet 22 (but not pillow means "P") to apron member 10, but in embodiment "E5" such apron connecting sewing line 12 permanently attaches pillowcase "PC" (and hence the pillow "P5") to pockets-forming sheeting means 21 and 22 and to apron member 10. As previously alluded to, the bedstrap anchoring ties are also attachable to apron member 10 by said stitching line 12. Moreover, as compared to embodiment "E1", the casing wings'said lengthy peripheral stitching lines 18J and 18K also grasp similarly lengthy portions of pillowcase "PC"; this provides two distinct upwardly vertically open plural-pockets stations (28, 29) on both lateral sides of vertical plane "PV".

As noted above, in embodiments "E1" and "E5", there are two vertically open plural-pockets stations (28, 29) located on both lateral sides of the pillow means vertical plane "PV", all four pockets being upwardly vertically open and having two closed upright ends. Embodiment "E6" of FIGS. 13 and 14 also has two vertically openable plural-pockets stations (e.g. 28A, 29) located on both lateral sides of vertical plane "PV". And similarly to embodiments "E1" and "E5", in embodiment "E6" two of the vertical axis flanking pockets (e.g. 29) are upwardly open. However, as seen in FIG. 14, embodiment "E6" differs in that the two remaining flanking pockets (e.g. 28A) are downwardly open.

Figure 13:
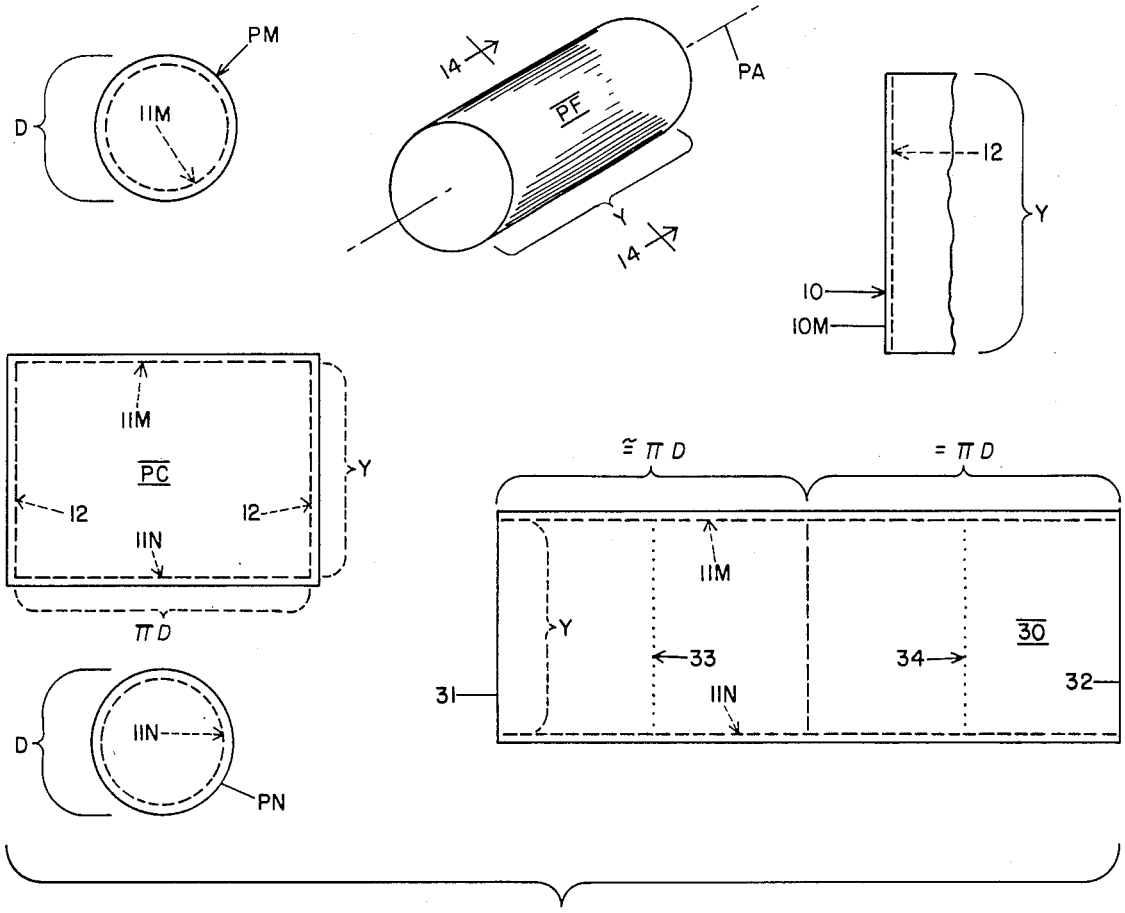
FIG. 13 is an exploded assembly view that schematically depicts the several components utilized for embodiment "E6".
Figure 14:
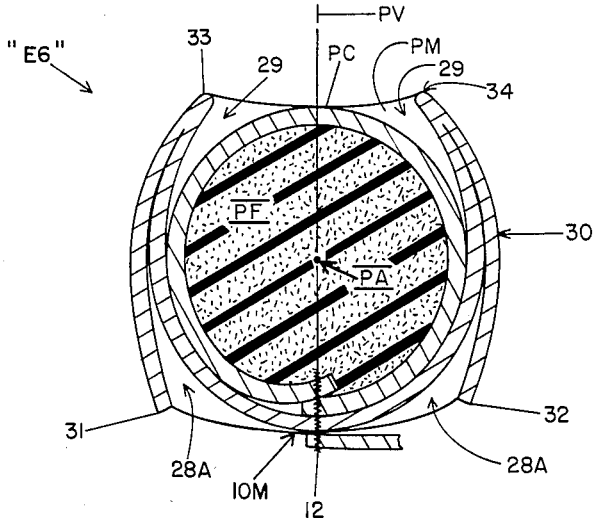
FIG. 14 is a sectional elevational view, akin to FIGS. 2 and 11, of a sixth embodiment "E6"

Before making a more detailed comparison of the "E6" Figure 14 with analagous FIGS. 2 and 11, FIG. 13 will provide a clarifying prelude to FIG. 14. The FIG. 13 exploded assembly view schematically depicts five patterned pieces of flexible textile fabric (10, 30, "PC", "PM", and "PN") and the aforedescribed cylindrical filling "PF"; these six components (when sewn together along sewing lines 11M, 11N, and 12) provide embodiment "E6". The two circular pattern pieces "PM" and "PN" (each having the diameter "D") are locatable at the two circular ends of cylindrical filling "PF". The rectangular pattern piece "PC" (having a "$\pi$D" length between sewing lines 12) is capable of surrounding the entire longitudinal extent "Y" of filling "PF". Rectangular pattern piece 30 has widthwise: free-ends 31 and 32 of lengths "Y"; a central sewing line 12 positioned approximate distances "$\pi$D" from ends 31 and 32; and offset fold lines 33 and 34 flanking sewing line 12.

Three elongate stitchings effected along the thusly positioned sewing lines 11M, 11N, and 12, of the five patterned pieces ("PM", "PN", "PC", 30, and 10) provide the FIG. 14 embodiment "E6", and which is generally akin to embodiments "E1" and "E5" of FIGS. 2 and 11. In other words, pairs of vertically extending openable pockets exist on both lateral sides of vertical plane "PV", each of said pockets having both longitudinally separated ends closed. But for embodiment "E6", some of the vertically extending pockets are downwardly open, namely:

(a) on one lateral side of vertical plane "PV", an upwardly open pocket 29 is located between casing "PC" and fold line 33, but a downwardly open pocket 28A is located between free-end 31 and sewing line 12; and similarly (b) on the other lateral side of vertical plane "PV", an upwardly open pocket 29 is located between casing "PC" and fold line 34, but a downwardly open pocket 28A is located between free-end 32 and sewing line 12.

Accordingly, embodiment "E6", which includes all the salient structural features of embodiments "E1" and "E5", has more clinical versatility than do these previously discussed embodiments.

From the foregoing, the construction and clinical usages of the prop-like positioning device will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. For usage in removable combination with a lofty pillow means extending lengthwise along a longitudinal-axis, a launderable support that provides, in combination with a said pillow means, a prop-like positioning device for a directionally longitudinally reclining person, said launderable support comprising:

(A) a flexible fabric apron member extending directionally laterally lengthwise along a substantially horizontal lateral-axis, said apron having a pair of broad planar surfaces including a lower-surface adapted to be superimposed upon a horizontal reclining surface and an upper-surface adapted to support in transversely extending relationship thereto the longitudinally extending torso of a hemiside reclining person;

(B) a longitudinally extending flexible casing adapted to removably surround a said pillow means loftily overlying said apron member and being attached to said underlying apron member along a vertical plane extending substantially along said longitudinal-axis; and (C) longitudinally extending pockets-forming sheeting means intervening between the attached apron and casing, said pockets-forming sheeting means on at least one lateral side of the casing providing a plurality of longitudinally extending distinct pockets, each of said distinct pockets being vertically-open and having two longitudinally separated closed ends, whereby for a hemiside reclining person facing away from said pillow means casing, at least two said laterally sequentially spaced distinct pockets intervene between the person's spinalside and the pillow means casing.

2. The launderable support of claim 1 wherein the casing and an underlying pockets-forming sheeting means is attached along a longitudinally extending stitching line to the said apron member therebelow; and wherein on each lateral side of said pillow means casing at least two said closed ends and vertically open distinct pockets are present.

3. The launderable support of claim 2 wherein said pockets-forming sheeting means comprises a secondary-sheet overlying a similar primary-sheet, said primary-sheet and said secondary-sheet respectively extending from said longitudinal stitching whereby a pair of upwardly vertically open pockets exist of both lateral sides of said pillow means casing.

4. The launderable support of claim 2 wherein said pockets-forming sheeting means comprises a lengthy folded-sheet having a pair of lofty folds located on both lateral sides of said pillow means casing whereby one upwardly vertically open and one downwardly vertically open pocket exist on both lateral sides of said pillow means casing.

5. The launderable support of claim 1 wherein there are bedstrap anchoring means attached to the pillow means casing and extending below the apron member lower -surface for removably anchoring to a bedstrap environment therebelow.

6. The invention of claim 5 wherein the apron member is apertured to provide access to the bedstrap anchoring means by a said hemiside reclining person.

7. The invention of claim 6 wherein the apron member, remote from the pillow means casing, is provided with frontal-support means for the reclining person's anteriorside.

8. The invention of claim 7 wherein the frontal-support means comprises at least one longitudinally extending and stuffable apron-channel.

9. The invention of claim 8 wherein the frontal-support means comprises at least one upstanding loop permitting attachment thereto of an auxiliary-pillowmeans.

10. A prop-like positioning device for a directionally longitudinally reclining person, said positioning device comprising:

(A) a lofty pillow means extending lengthwise along a longitudinal-axis;

(B) a flexible apron member extending directionally laterally lengthwise along a substantially horizontal lateral-axis, said apron having a pair of broad planar surfaces including a lower-surface superimposable upon a reclining surface and an upper-surface adapted to support in transversely extending relationship thereto the longitudinally extending torso of a hemiside reclining person, said apron member being attached to said overlying pillow means along a vertical plane extending substantially along said pillow means longitudinal-axis; and (C) longitudinally extending pockets-forming sheeting means intervening between said attached apron and pillow means, said pockets-forming sheeting means on at least one lateral side of the pillow providing a plurality of longitudinally extending and distinct pockets, each of said distinct pockets being vertically-open and having two longitudinally separated closed ends, whereby for a hemiside reclining person, at least two laterally sequentially spaced distinct pockets intervene between the reclining person and the pillow means.

11. The prop-like positioning device of claim 10 wherein said pockets-forming sheeting means provides on each lateral side of said lofty pillow means at least two said vertically-open and closed ends pockets.

12. The invention of claim 11 wherein said pockets-forming sheeting means comprises a secondary-sheet overlying a similar primary-sheet, said primary-sheet and secondary-sheet respectively extending upwardly from longitudinal attachment to the apron means whereby a pair of upwardly vertical open pockets exist on both lateral sides of said pillow means.

13. The invention of claim 11 wherein said pockets-forming sheeting means comprises a lengthy folded-sheet centrally attached to said apron member and having a pair of lofty folds located on both lateral sides of said pillow means whereby one upwardly vertically open and one downwardly vertically open pocket exist on both lateral sides of said pillow means.

14. The prop-like positioning device of claim 11 wherein there are bedstrap anchoring means attached to the pillow means and extending below the apron member lower-surface for removably anchoring to a bedstrap environment therebelow.

15. The invention of claim 14 wherein the apron member is apertured to provide access to a bedstrap anchoring means by a said hemiside reclining person, and said apron member (remote from the pillow means) being provided with a frontal-support means for the reclining person's anteriorside.

16. The invention of claim 15 wherein the frontal-support means comprises at least one longitudinally extending apron-channel and also at least one upstanding loop permitting attachment thereto of an auxiliary-pillow-means.

17. The invention of claim 16 wherein the pillow means takes the form of a cylindrical bolster, said bolster having bedstrap anchoring means extending downwardly through an apertured portion of the apron member.

18. The prop-like positioning device of claim 11 wherein a resiliently-layered rigid board is in removably inserted condition within at least one of said vertically open pockets.

19. For usage in removable combination with a lofty pillow means extending lengthwise along a longitudinal-axis, a launderable support that provides, in combination with a said pillow means, a prop-like positioning device for a directionally longitudinally reclining person, said launderable support comprising:

(A) a flexible fabric apron member extending directionally laterally lengthwise along a substantially horizontal lateral-axis, said apron having a pair of broad planar surfaces including a lower-surface adapted to be superimposed upon a horizontal reclining surface and an upper-surface adapted to support in transversely extending relationship thereto the longitudinally extending torso of a hemiside reclining person;

(B) a longitudinally extending flexible casing adapted to removably surround a said pillow means loftily overlying said apron member and being attached to said underlying apron member along a vertical plane extending substantially along said longitudinal-axis; and (C) longitudinally extending pockets-forming sheeting means intervening between the attached apron and casing, said pockets-forming sheeting means on both lateral sides of the casing providing a plurality of distinct longitudinally extending and vertically-open pockets, whereby for a hemiside reclining person facing away from said pillow means casing, at least two said laterally sequentially spaced distinct and vertically-open pockets intervene between the person's spinalside and the pillow means casing.

* * * * *